United States Patent [19]

Shintani

[11] Patent Number: 4,509,875

[45] Date of Patent: Apr. 9, 1985

[54] FELT PEN HAVING TWO END CAPS

[75] Inventor: Koichi Shintani, Tokyo, Japan

[73] Assignee: Colleen Pencil Co., Ltd., Tokyo, Japan

[21] Appl. No.: 451,541

[22] Filed: Dec. 21, 1982

[30] Foreign Application Priority Data

Nov. 30, 1982 [JP] Japan ..... 57-180032[U]

[51] Int. Cl.[3] ..... B43K 9/00; B43K 8/02; B43K 27/00

[52] U.S. Cl. ..... 401/34; 401/17; 401/20; 401/202

[58] Field of Search ..... 401/34, 17, 19, 20, 401/192, 21, 23, 202, 98

[56] References Cited

U.S. PATENT DOCUMENTS

| | | | |
|---|---|---|---|
| 1,468,123 | 9/1923 | Miller | 401/17 |
| 2,233,846 | 3/1941 | Packard | 401/192 |
| 3,684,389 | 8/1972 | Eron et al. | 401/34 X |

FOREIGN PATENT DOCUMENTS

| | | | |
|---|---|---|---|
| 2494637 | 5/1982 | France | 401/34 |

*Primary Examiner*—Steven A. Bratlie
*Attorney, Agent, or Firm*—Michael J. Striker

[57] ABSTRACT

A felt pen comprises a bar shaped main body defined with linear line and taper line, and transparent caps for writing tips at the both ends of the main body. Each of the caps stands with the main body thereon and may be mounted on the other cap.

3 Claims, 2 Drawing Figures

FELT PEN HAVING TWO END CAPS

BACKGROUND OF THE INVENTION

This invention relates to a felt pen in general and more particularly to an improved pen which can stand on either of its both ends, and has a good outer appearance, and the tips of which are visible through transparent caps.

There have been many kinds of felt pens which have writing portions at the both ends, but all of them have some disadvantages. The writing portions at both ends of the pen are for thick letter and thin letter respectively and they are invisible due to the covering caps. Therefore selection for use is confirmed by taking off either one. Further, since the pen cannot stand on any cap at each end of the ends the lying felt pens often stain papers.

In addition, since a main part around the thin letter side of the pen has not been given special attention to, it could slip out from the user's hand during writing.

SUMMARY OF THE INVENTION

This invention has been devised to avoid the disadvantages of conventional felt pens.

A basic object of the invention is to define an outer shape of the product with linear line and taper line to produce a modern type appearance. The product can stand on either of its ends.

A further object of the invention is to provide a knurling on a grip of a small diameter part.

Another object of the invention is to make the caps of transparent materials through which the capped tips are visible so that a fat square tip and a thin round tip can be recognized.

A still further object of the invention is to mount a rest cap on the other using cap.

Other features and actual working effects will be apparent from the following description of embodiments of the invention.

DETAILED DESCRIPTION OF THE PREFERRED EMBODIMENT

Figure 1:
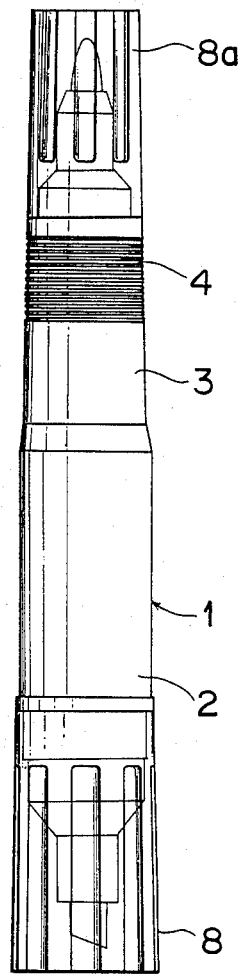
FIG. 1 is an axial elevation view of a felt pen according to the invention.

The invention will be explained with reference to the attached drawing. Reference numeral 1 designates a bar like main body, an outer shape of which is defined with linear line 10 and taper line 12. The main body has a grip portion 2 of larger diameter and a grip portion 3 of smaller diameter which is formed with a knurling 4 thereon acting as a slip stopper. The main body 1 is provided with sleeves 5, 5*a* at its both ends, and there are provided a thicker square tip 6 for thick letter in the sleeve 5 of the larger diameter and a thinner round tip 6*a* for thin letter in the sleeve 5*a* of the smaller diameter.

Reference numeral 7 denotes a sponge-like ink impregnated part which is held within the main body 1, and tips 6, 6*a* communicate with the ink-impregnated part 7 at the inner ends thereof.

Figure 2:
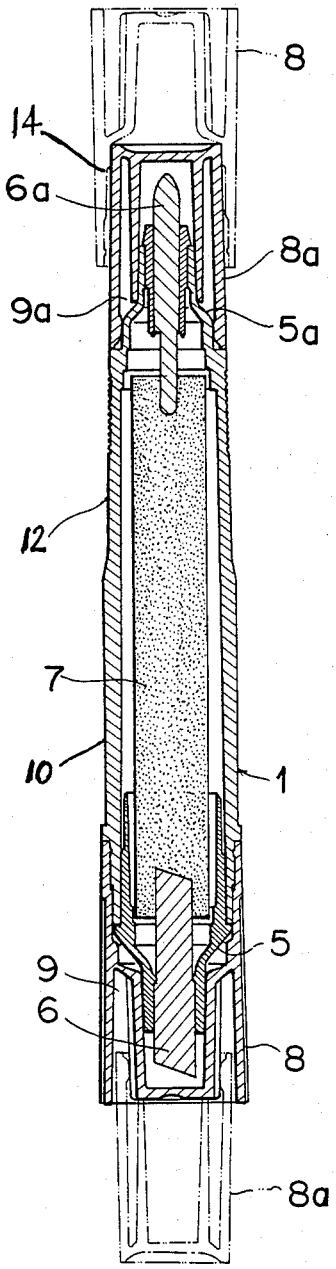
FIG. 2 is an axial cross sectional view of the pen of FIG. 1.

Reference numerals 8, 8*a* identify cylindrical caps of the large diameter side and the smaller diameter side of the main body 1. Both of the caps 8 and 8*a* are formed of transparent materials, and can hold the main body 1 thereon while in the vertical position. The cap 8 is formed with a groove 9 in its head, and the other cap 8*a* is formed with a groove 9*a* provided at its interior. The grooves 9, 9*a* are convenient when the cap 8*a* of the smaller diameter side is mounted on the cap 8 of the larger diameter side, as shown in FIG. 2 with phantom lines as seen at the lower side of the drawing. Cap 8 on the contrary can only be put on the cap 8*a* of the smaller diameter side. Since each of the caps can be fitted on the opposite one, they are convenient in use.

According to the present invention, since the outer shape of the main body is defined with the linear line and the taper line, the appearance of the pen is attractive, and as the cap can hold the main body, the tip with the cap removed does not stain papers.

The grip of the smaller diameter part is formed with the knurling so that the user's felt pen does not slip out from the hand.

The both caps are made of the transparent materials, and the tips can be distinguished each other as the caps are used.

As seen in FIG. 2 cap 8 shown in fanthom line has a recess 14 which surrounds the outer surface of cap 8*a* such as to be clamped thereon whereby cap 8 of the larger diameter can be positioned on cap 8*a* of the smaller diameter.

It will be understood that each of the elements described above, or two or more together, may also find a useful application in other types of felt pens differing from the types described above.

While the invention has been illustrated and described as embodied in a felt pen, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Leters Patent is set forth in the appended claims:

1. A felt pen, comprising a bar-shaped hollow body; an ink-impregnated sponge supported within said body, said body having two opposite ends; two writing tips mounted at said opposite ends, respectively, in said body; and two caps detachably-attachable to said body at said opposite ends, respectively to close the respective tips, said body having an outer shape, said shape being defined by a linear line and a taper line merging into said linear line, said linear line defining a first grip portion of said body and said taper line defining a second grip portion of said body, one of said writing tips being of a larger size and of a square cross-section and another of said writing tips being of a smaller size and of a round cross-section, said caps having each an end surface so that when the cap is attached to said body the latter can stand on the end surface of the respective cap, one of said caps being of a larger outer diameter and another of said caps being of a smaller outer diameter, one of said caps being formed with one groove and another of said caps being formed with another groove, the cap of the smaller outer diameter being adapted to be mounted on the cap of the larger outer diameter such that said another cap is partially inserted into the respective groove of said one cap, the cap of the larger outer diameter being adapted to be mounted on the cap of the smaller outer diameter.

2. The pen as defined in claim 1 wherein said caps are formed of transparent material.

3. The pen as defined in claim 1, wherein said second grip portion is formed with a knurling on an outer surface thereof.

* * * * *